US011927060B2

(12) United States Patent
Wijning

(10) Patent No.: US 11,927,060 B2
(45) Date of Patent: Mar. 12, 2024

(54) OFFSHORE VESSEL AND METHOD OF OPERATION OF SUCH AN OFFSHORE VESSEL

(71) Applicant: ITREC B.V., Schiedam (NL)

(72) Inventor: Diederick Bernardus Wijning, Schiedam (NL)

(73) Assignee: ITREC B.V., Schiedam (NL)

( * ) Notice: Subject to any disclaimer, the term of this patent is extended or adjusted under 35 U.S.C. 154(b) by 0 days.

(21) Appl. No.: 17/925,704

(22) PCT Filed: May 21, 2021

(86) PCT No.: PCT/EP2021/063630
§ 371 (c)(1),
(2) Date: Nov. 16, 2022

(87) PCT Pub. No.: WO2021/239613
PCT Pub. Date: Dec. 2, 2021

(65) Prior Publication Data

US 2023/0203897 A1 Jun. 29, 2023

(30) Foreign Application Priority Data

May 28, 2020 (NL) ..... 2025697

(51) Int. Cl.
*E21B 19/02* (2006.01)
*E21B 19/09* (2006.01)

(52) U.S. Cl.
CPC ..... *E21B 19/09* (2013.01); *E21B 19/02* (2013.01)

(58) Field of Classification Search
CPC ..... E21B 19/02; E21B 19/09
See application file for complete search history.

(56) References Cited

U.S. PATENT DOCUMENTS

| | | | | |
|---|---|---|---|---|
| 5,762,279 | A * | 6/1998 | Horton, III | E21B 19/02 254/285 |
| 10,253,572 | B2 * | 4/2019 | Braniff | E21B 19/14 |
| 10,544,633 | B2 * | 1/2020 | Huchon | E21B 15/00 |
| 10,570,672 | B2 * | 2/2020 | Kannegaard | E21B 19/143 |
| 2017/0074057 | A1 | 3/2017 | Roodenburg et al. | |
| 2019/0112881 | A1 * | 4/2019 | Aslaksen | E21B 19/008 |
| 2019/0256173 | A1 | 8/2019 | Roodenburg et al. | |

OTHER PUBLICATIONS

Dutch Search Report, issued in Priority Application No. 2025697, dated Jan. 22, 2021.
International Search Report, issued in PCT/EP2021/063630, dated Jul. 23, 2021.
Written Opinion of the International Searching Authority, issued in PCT/EP2021/063630, dated Jul. 23, 2021.

* cited by examiner

*Primary Examiner* — Matthew R Buck
(74) *Attorney, Agent, or Firm* — Birch, Stewart, Kolasch & Birch, LLP

(57) ABSTRACT

An offshore vessel for performing offshore subsea wellbore related activities, for example for drilling a subsea wellbore includes a drilling tower. A method for drilling a subsea wellbore includes using an offshore vessel and a method for tripping a tubulars string is disclosed. The offshore vessel is provided with a hoisting system which has a first configuration, wherein a hoisting cable is connected to a working deck and a second configuration wherein said hoisting cable is connected to a traveling block. The system allows for efficient tripping in and tripping out.

15 Claims, 10 Drawing Sheets

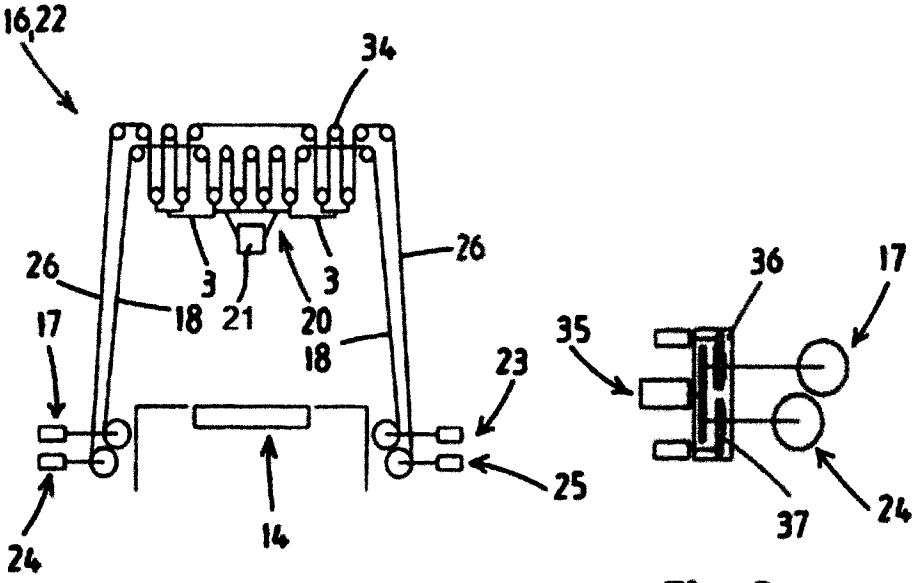
Fig. 9c
Fig. 9b
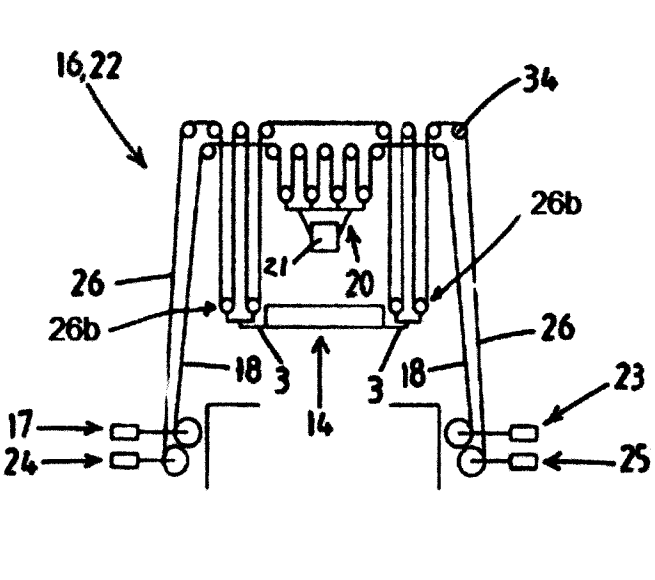
Fig. 9a

OFFSHORE VESSEL AND METHOD OF OPERATION OF SUCH AN OFFSHORE VESSEL

FIELD OF THE DISCLOSURE

The present invention relates to an offshore vessel for performing offshore subsea wellbore related activities, for example for drilling a subsea wellbore. The offshore vessel comprises a drilling tower. The invention further relates to a method for drilling a subsea wellbore wherein use is made of an offshore vessel according to the invention and to methods for tripping a tubulars string.

BACKGROUND

Tubulars strings are used in the offshore industry for various purposes. The tubulars string may, for example, be a drill string used for drilling the subsea wellbore. These tubulars strings are made up of tubulars which are connected, for example threadingly connected, end to end to each other to form the tubulars string. Each tubular is, for example, 12 meters long, whereas a wellbore can have a depth of several kilometers. Thus many tubulars are needed to form a tubulars string that reaches the bottom of the wellbore.

At times during drilling of the wellbore, the tubulars string has to be removed from the wellbore. For example to replace the drill bit, which wears down from drilling through hard layers. The process of removing the drill string from the wellbore is called tripping out. Similarly, for example after replacing the drill bit, the entire tubulars string has to be put back into the wellbore. This process is called tripping in. During tripping the entire tubulars string has to be dismantled into tubulars, e.g. stands of tubulars, e.g. doubles or triples. Tripping is a time consuming process which is preferably carried out as fast and efficiently as possible.

Tripping out is traditionally performed by pulling the drill string out of the wellbore for about a length of a tubular or a length of multiple tubulars, called a stand. The top tubulars are then removed and placed in a storage. The tubulars string is subsequently pulled out of the wellbore for another length and the process is repeated. This process is not satisfactory as the tubulars string is not being pulled out of the wellbore each time a tubular is being removed from the tubulars string, thus costing valuable time. Additionally, the repeated starting and stopping of the tubulars string may damage the tubulars string and the wellbore and cause subterranean shocks which may have adverse effects. Tripping in is performed similarly and has similar disadvantageous effects.

SUMMARY

It is an object of the invention is to provide a versatile offshore vessel. For example, the invention aims to provide an offshore vessel that allows for more efficient tripping operations. Another aim of the invention is to provide an offshore vessel that allows for faster tripping.

The present invention provides an offshore vessel according to claim 1.

An advantage of the offshore vessel according to claim 1 is that the second hoisting device allows for movement of the working deck independent of the traveling block during tripping. This allows for continuous tripping because it allows for the tubulars string to continue to move while a tubulars is being attached or detached from the tubulars string. For example, during tripping in a tubulars string is suspended from the working deck, via the slip device, while the working deck is being lowered. A tubular is placed between the working deck and the traveling block by the tubulars handling device and is attached to the tubulars string by the roughneck device, which is moved in a vertical direction relative to the drilling tower while the tubulars string and working deck is still being lowered. Next, the lengthened tubulars string is suspended from the traveling block, which is also moving downward, and is disengaged from the slip device on the working deck. The working deck is then raised while the traveling block and tubulars string are moved downward. When the working deck reaches the top of the tubulars string the tubulars string is once again suspended from the working deck via the re-engaged slip device and is disengaged from the traveling block. The traveling block then moves upwards and a new tubular is placed between the traveling block and the tubulars string.

A further advantage of the offshore vessel according to claim 1 is that it allows for an enhanced distribution of hoisting capacities. The second hoisting winch can raise and lower the working deck when it is attached to the working deck and the first hoisting winch can raise and lower the traveling block at all times. In cases when the traveling block needs to hoist a heavy load, such as a lengthy drill string, both hoisting devices are connected to the traveling block. Thus the first hoisting device is not required to be able to hoist maximum firing line related loads by itself. This allows for a reduction in power and size of the first hoisting device, leading to a more efficient offshore vessel.

The offshore vessel of the invention is adapted for performing subsea wellbore related activities, such as drilling a subsea wellbore. The offshore vessel may also be adapted for other well entry operations, such as installing and removing of a subsea well control device, performing well interventions, e.g. coiled tubing operations and wirelining, e.g. for introducing chemical components into a well, or to perform measurements in the well, such as temperature and/or pressure measurements.

The offshore vessel according to the invention is, for example, a monohull vessel or a semi-submersible vessel. For example, a moon pool is provided in the hull of the vessel. The drilling vessel may be a jack up type vessel. In an embodiment, the offshore vessel, e.g. a jack-up type vessel, may comprise a cantilever wherein the drilling tower is placed on the cantilever.

A tubulars storage rack adapted to store multiple tubulars maybe provided on the drilling vessel. The tubulars storage rack is, preferably, provided adjacent to or integrated with the drilling tower to allow easy transfer of tubulars between the firing line and the storage rack. The tubulars storage rack preferably allows the tubulars, e.g. stands of interconnected tubulars, to be stored in a vertical orientation.

The vessel is further provided with a roughneck device for connecting and disconnecting tubulars to and from the tubulars string. The roughneck device is vertically moveable relative to the drilling tower to allow for connecting and disconnecting a tubular from the tubulars string while the tubulars string is moving in a vertical direction. The roughneck device is, for example, provided on the mobile working deck. This allows the roughneck device to be located close to the connection between two tubulars. The roughneck device may, alternatively, be mounted on a motion arm assembly that is mobile vertically relative to the tower. For example, the motion arm assembly includes a telescopic arm allowing for the roughneck device to be moved into and out of the firing line.

The offshore vessel is further provided with a tubulars handling device, for example a tubulars racking device having at least a lower first tubular racker assembly and at least a second tubular racking assembly. In this example, the second tubular racking assembly is operable at a greater height than the first tubular racking assembly. The tubulars handling device is adapted to grip and retain a tubular and to place a tubular in and remove a tubular from a tubulars storage rack. The tubulars handling device may allow transportation of the tubulars from a position in the firing line to a position in a tubulars storage rack.

For example, the tubulars racking device may have a reach at least allowing to transfer a tubular gripped by the first and second tubular racker assemblies between the tubulars storage rack and a position of the tubular aligned with the firing line of the offshore vessel. Each tubular racker assembly is vertically moveable between a lower position and a raised position. The tubulars may be stored at a different height than the height where they are placed in the firing line. Thus, it is advantageous that the racker assemblies are vertically moveable. Additionally, during the tripping process according to the invention, the tubular racker assembly may move in a vertical direction, e.g. in coordination with vertical motion of the working deck and the slip device thereon.

The offshore vessel further comprises a vertically mobile working deck, wherein the firing line extends through an opening in the working deck. A slip device is provided on the working deck. The slip device is adapted to suspend the tubulars string therefrom when the slip device is engaged to the tubulars string. The working deck may comprises a surface where an operator of the offshore vessel may walk. In another embodiment, the working deck does not comprise such a surface. The working deck supports the slip device and connection means to connect the second hoisting cable.

The first hoisting device of the invention comprises a first hoisting winch and a first hoisting cable connected to the first hoisting winch. The first hoisting device is adapted to raise and lower the tubulars string in the firing line. The first hoisting winch may be attached to the drilling tower, located adjacent to the drilling tower, or it may be located on a different place on the drilling vessel.

The crown block is preferably located near a top of the drilling tower. A traveling block is suspended from the crown block by the first hoisting cable. The traveling block is adapted to suspend the tubulars string along the firing line. The traveling block is adapted to move in a vertical direction along the drilling tower to allow raising and lowering of the tubulars string. The traveling block may carry a top drive device for driving rotation of the tubulars string, for example during a drilling operation. The traveling block may be connected to a trolley which is guided relative to the drilling tower by one or more trolley rails. This allows the traveling block to be more stable against movement, for example, in a horizontal direction.

The offshore vessel further comprises a second hoisting device that comprises a second hoisting winch and a second hoisting cable. The second hoisting winch may be of the same shape and size as the first hoisting winch. It may also be of a different shape and size. The second hoisting cable is connected to the second hoisting winch. The second hoisting device further comprises at least one connector that is adapted to selectively be connected to one of the working deck and the traveling block. The working deck and traveling block comprise compatible connection means. The connector allows the second hoisting device to either hoist the traveling block in conjunction with the first hoisting device, or to independently hoist the working deck. This allows for extra hoisting capability of the traveling block and for flexible and independent hoisting of the working deck relative to the traveling block. When the connector is connected to the working deck, the working deck can be raised and lowered by the second hoisting device, and when the connector is connected to the traveling block the traveling block is suspended by both the first and second hoisting cables.

In an embodiment, the first hoisting winch comprises a first hoisting drum and the second hoisting winch comprises a second hoisting drum. In an embodiment, the first hoisting drum and second hoisting drum are connected to a common winch drive by a first transmission and a second transmission respectively, allowing the common winch drive to drive the first hoisting drum and the second hoisting drum.

The first hoisting cable may be rolled onto the first hoisting drum and the second hoisting cable may be rolled onto the second hoisting drum. Both hoisting drums may be connected to a single common winch drive. The first hoisting drum may be connected through a first transmission to the common drive and the second hoisting drum may be connected through a second transmission to the common drive. This allows the common winch drive to drive the first hoisting winch and second hoisting winch independently. This embodiment is advantageous because this eliminates the need for a second winch drive for the second hoist device, while it retains the flexibility of the system of the invention. The common winch drive is, preferably, adapted to hoist a maximum firing line load, for example, the weight of a long drill string.

In an embodiment, the first transmission and the second transmission, each comprise a planetary gear system. These planetary gear systems allow for flexible connection between the winch drive and the first and second hoisting drums. The planetary gear systems further allow for flexible power distribution between the first and second hoisting drums. In other embodiments the transmissions may comprise different systems.

In an embodiment, the offshore vessel is a floating offshore vessel and further comprises a first heave compensation system for damping the effect of the movement of the vessel as a result of sea-state induced vessel motion on the first hoisting device and a second heave compensation system for damping the effect of the movement of the vessel as a result of sea-state induced vessel motion on the second hoisting device.

These heave compensated systems, preferably, each have an active and a passive heave compensation component. For example, the passive heave compensation system comprises a hydraulic cylinder connected to a pulley which engages on the first or second hoisting cable. In another embodiment the heave compensation system engages on the winch drive of the offshore vessel. The heave compensation systems allow for heave compensation of the offshore vessel thus improving the system.

In an embodiment, the first hoisting system comprises a third hoisting winch, wherein the first hoisting winch is connected to a first end of the first hoisting cable and the third hoisting winch is connected to a second end of the first hoisting cable. In this embodiment the first hoisting cable may be connected to a drum on both ends of the hoisting cable. This, for example, allows to shifting of the cable relative to the pulleys along with the cable passes, e.g. during heave compensated operations, e.g. in view of reduced local wear. In addition, redundancy may be achieved.

In an embodiment, the second hoisting system comprises a fourth hoisting winch, wherein the second hoisting winch is connected to a first end of the second hoisting cable and wherein the fourth hoisting winch is connected to a second end of the second hoisting cable. Similarly to the above embodiment, in this embodiment the second hoisting cable may be is connected to a drum on both ends of the hoisting cable.

In an embodiment, the third hoisting winch comprises a third hoisting drum and the fourth hoisting winch comprises a fourth hoisting drum. In an embodiment, the third hoisting drum and the fourth hoisting drum are connected to a second common winch drive by a third transmission and a fourth transmission respectively, allowing the second common winch drive to drive the third hoisting drum and the fourth hoisting drum. This embodiment is, preferably, combined with the embodiment comprising a first and second drum connected to a common first winch drive. In this embodiment, flexible hoisting is possible with an increased hoisting capacity. In this embodiment, it is possible that the first winch drive not able to hoist a maximum weight of the tubulars string and that the maximum weight of the tubulars string has to be hoisted by the first and second winch drives. This allows for relatively compact winch drives.

In an embodiment, the tubulars handling device comprises a lower first tubular racker assembly and a second tubular racking assembly operable at a greater height than the first tubular racker assembly. For example, each assembly comprises a base, a motion arm connected to the base, and a tubular gripper member held by the motion arm. This allows for versatile racker assemblies. The tubular gripper member is adapted to grip a tubular. Preferably, the motion arm can swing about a vertical axis as it is connected through a bearing to the base. Preferably, the base is mobile vertically, which allows both rotational as well as vertical movement of the motion arm. In embodiments, it is possible that there are more than two motion arms, for example three motion arms. In embodiments the roughneck device is connected or connectable to one of the motion arms to allow for the roughneck device to be moveable in and out of the firing line and up and down relative to the firing line, e.g. in coordination with heave compensated motion of the working deck.

In an embodiment, the working deck is located above a moon pool and wherein the working deck covers at least a portion of the moon pool. This allows the working deck to be placed on top of the moon pool when the working deck is not connected to the second hoisting cable.

In an embodiment, the hoisting system comprises an electronic system for controlling the first hoisting device and the second hoisting device. The electronic system, preferably, controls the winch devices to allow for performing continuous tripping, e.g. in automated manner.

In an embodiment, the electronic system comprises load sensors to measure loads on the first and second hoisting devices. This allows the system to warn when a maximum load is about to be exceeded. Additionally, tripping may be performed automatically using the electronic system.

In an embodiment, the hoisting system further comprises a tubulars storage rack adapted to store multiple tubulars, wherein the tubulars handling device is adapted to place a tubular in and remove a tubular from the tubulars storage rack, and wherein the tubulars handling device has a reach at least allowing to transfer a gripped tubular gripped between the tubulars storage rack and a position of the tubular aligned with the firing line.

The invention also relates to a method for drilling a subsea wellbore wherein use is made of an offshore vessel according to one or more of the claims 1-11.

In an embodiment, the method comprises a tripping-in routine which comprises the steps of:

- connecting the second hoisting cable to the working deck using the connector so as to bring the hoisting system in the first configuration;
- suspending the tubulars string from the traveling block;
- engaging the tubulars string with the slip device on the working deck near a top end of the tubulars string and releasing the tubulars string from the traveling block thus suspending the tubulars string from the slip device;
- lowering the working deck and the tubulars string while simultaneously raising the traveling block thereby creating a space for a tubular between the working deck and the traveling block;
- placing a tubular in the firing line between the working deck and the traveling block by means of the tubulars handling device;
- connecting, by means of the roughneck device, the tubular with the tubulars string while the working deck is being lowered by the second hoisting device;
- lowering the traveling block and connecting the traveling block to a top end of the tubulars string;
- releasing the tubulars string from the slip device thereby suspending the tubulars string from the traveling block;
- lowering the traveling block and the tubulars string while simultaneously raising the working deck.

This method allows for continuous tripping in of the tubulars string.

It is also possible that the method comprises a tripping out routine which comprises:

- connecting the second hoisting cable to the working deck using the connector so as to bring the hoisting system in the first configuration;
- suspending the tubulars string from the traveling block;
- raising the traveling block and the tubulars string while lowering the working deck;
- engaging the slip device of the working deck to the tubulars string below an upper tubular, while the working deck, traveling block and tubulars string are being raised;
- separating the upper tubular from the tubulars string using the roughneck device;
- removing the upper tubular from the firing line using the tubulars handling device;
- lowering the traveling block while simultaneously raising the working deck and tubulars string;
- connecting the tubulars string to the traveling block and disengaging the slip device from the tubulars string thus suspending the tubulars string from the traveling block;
- raising the traveling block and the tubular while simultaneously lowering the working deck.

This method allows for continuous tripping-out of the tubulars string.

In an embodiment the method comprises a drilling routine which comprises:

- connecting the second hoisting cable to the traveling block using the connector so as to bring the hoisting system in the second configuration;
- suspending the tubulars string from the traveling block;
- connecting the top drive to the tubulars string; and performing wellbore drilling operations by hoisting the traveling block and tubulars string with the hoisting system and driving the tubulars string with the top drive.

BRIEF DESCRIPTION OF THE DRAWINGS

The invention will now be described in a non-limiting way by reference to the accompanying drawings in which like parts are indicated by like reference symbols and in which:

FIG. 9*a* depicts a schematic representation of the first hoisting device and the second hoisting device in a first configuration;

FIG. 9*b* depicts a schematic representation of the first hoisting device and the second hoisting device in a second configuration;

FIG. 9*c* depicts a schematic representation of a first hoisting winch and a third hoisting winch connected to a common winch drive;

DETAILED DESCRIPTION OF THE DISCLOSURE

Figure 1:
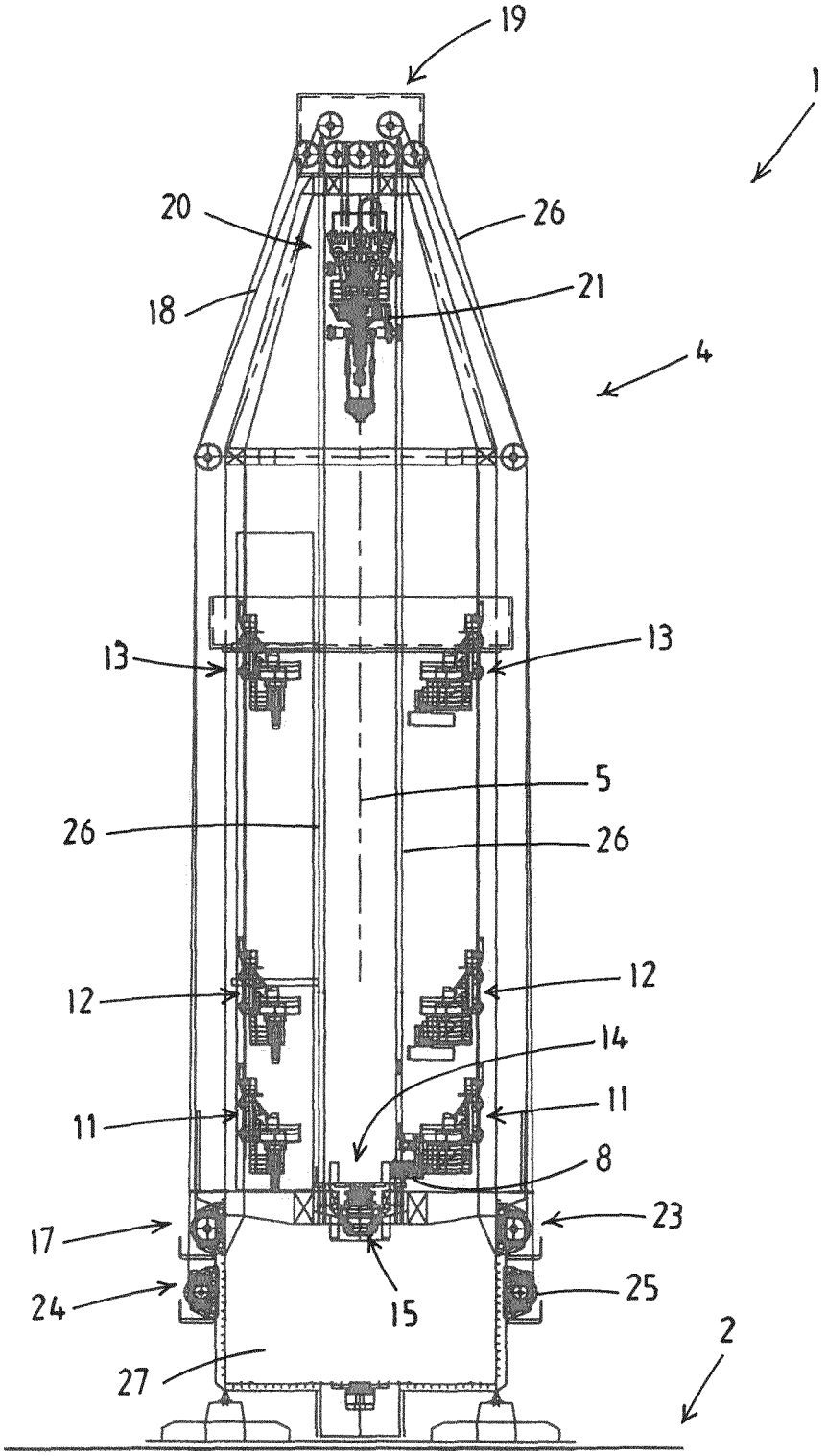
FIG. 1 depicts a front view of an offshore vessel according to the invention.

FIG. 1 shows a front view of an exemplary offshore vessel 1 according to the invention.

The offshore vessel 1 is in this example a jack-up drilling vessel having a deck box structure 2 and a cantilever 27 that is movable relative to the deck box structure, at least between an extended position and a retracted position.

In another embodiment, the vessel 1 is a floating vessel, e.g. a semi-submersible or a monohull vessel.

The offshore vessel 1 comprises a drilling tower 4, here the tower 4 is erected on the cantilever 27. The vessel 1, here the cantilever thereof, has a deck 27*a* at the lower end of the tower 4, e.g. the top deck of the cantilever 27.

A firing line 5 extends vertically so that wellbore related operations involving the drilling tower 4 are carried out along the firing line 5.

In FIG. 1 two tubulars storage racks 6 are visible. The storage racks 6 are each adapted to store therein multiple tubulars 7 in vertical orientation for use in a wellbore related process, e.g. a drilling process.

A roughneck device 8 is provided for connecting and disconnecting the tubulars 7 to and from a tubulars string 9. For example, the roughneck device 8 is operated to connect tubulars 7 to the tubulars string 9 during tripping-in of the tubulars string 9.

The tower 4 is provided with two vertical columns 4*b, c*, here arranged diametrically opposite from the firing line 5, that each support thereon multiple motion arm assemblies 11, 12, 13, here three motion arm assemblies per column. The assemblies are arranged above on another on the column 4*b, c*.

At least one tubulars handling device 10 is provided, which is adapted to grip and retain a tubular 7. The tubular racker device 10 may place a tubular 7 in and remove a tubular from the corresponding tubulars storage rack 6.

Each tubular racker device 10 illustrated here comprises the assembly 12 and the assembly 13.

In this embodiment, each assembly 11, 12, 13 comprises a base 28 and a motion arm 29 that is connected to the base 28. As preferred, each motion arm 29 is telescopically extendable and retractable by a telescoping mechanism. As preferred, each motion arm 29 can controllably swing in a horizontal plane as its inner end is rotatable about a vertical axis relative to the base 28 by a swing drive.

As preferred, two of the assemblies 12, 13 are each provided with a tubular gripper member 30 at the outer end of the motion arm 29 thereof.

The roughneck device 8 is connected to the lowermost motion arm assembly 11, for example as here, to the motion arm 29 of the assembly 11.

The multiple assemblies 11, 12, 13 are vertically movable, preferably independently, e.g. each by its own vertical drive, along the vertical column 4*b*, 4*c* of the drilling tower 4.

Each tubular racking device 10 has a reach that at least allows to transfer a tubular 7 that has been gripped by assemblies 12, 13 provided with a tubular gripper member 30 between the tubulars storage rack 6 and a position of the tubular 7 that is aligned with the firing line 5.

The offshore vessel 1 further comprises a working deck 14 that is vertically moveable relative to the drilling tower 4.

The firing line 5 extends through the working deck 14 such that a tubulars string 9 may pass through the working deck 14. The working deck 14 is provided with a slip device 15. The slip device 15 is adapted to suspend the tubulars string 9 therefrom when the slip device 15 is engaged onto the tubulars string 9.

The offshore vessel 1 further comprises a first hoisting device comprising a first hoisting winch 17, a third hoisting winch 23, and a first hoisting cable 18.

The first hoisting winch 17 and third hoisting winch 23 are located on a side of the cantilever 27 in this example. It is possible, in embodiments, that the first hoisting winch 17 and or the third hoisting winch are located on the deck of the vessel, for example when the drilling tower 4 is located on the deck of the vessel 1, or in the drilling tower 4.

The first hoisting cable 18 runs between the first hoisting winch 17 and the third hoisting winch 23, so one end is connected to winch 17 and the other end of winch 23.

The tower 4 supports a crown block 19. The crown block 19 comprises several pulleys to guide the first hoisting cable 18. A traveling block 20 is suspended from the crown block 19 by the first hoisting cable 18 in a multiple fall arrangement. In more detail, the crown block 19 has multiple pulleys 18*a* and the travelling block has one or more pulleys 18*b* to provide for the multiple fall arrangement.

The traveling block 20 is adapted to suspend the tubulars string 9 therefrom along the firing line 5.

In the figures the traveling block 20 carries a top drive 21 which is connectable to the top end of the tubulars string 9. As known in the art, the top drive 21 includes one or more motors to provide rotary torque to the string 9.

The traveling block 20 and the top drive 21 may be moved vertically by the first hoisting winch 17 and the third hoisting winch 23.

In the figure the top drive 21 is connected to a trolley 31 which moves along one or more vertical trolley guides, e.g. rails, on the drilling tower 4. This allows the top drive 21 to be guided by the trolley guides as the top drive 21 is moved in a vertical direction along the drilling tower 4.

A second hoisting device is provided comprising a second hoisting winch 24 and a fourth hoisting winch 25. The second hoisting device 22 further comprises a second hoisting cable 26 which is connected to at one end to the second hoisting winch 24 and at the other end to the fourth hoisting winch 25.

In FIG. 1 the second hoisting cable 26 is connected by the connector 3 to the working deck 14 such that the working deck 14 may be raised and lowered by the second hoisting device 22.

In more detail, the second hoisting cable 26 extends from pulleys 26*a* of the crown block 19 in two multiple fall arrangements to two horizontally spaced sets of one or more travelling pulleys 26*b*. Each set of one or more travelling pulleys 26*b* is mounted to a connector 3. Each connector 3 is selectively connectable to one of the working deck 14 and the traveling block 20.

The two multiple fall arrangements of the second hoisting cable 26, each supporting a respective one of the connectors 3, are each spaced on diametrically opposite sides of the firing line 5 so as to allow for open space for activities in the firing line 5 above the working deck 14.

In the FIG. 1 the working deck 14 is in a lower position thereof and the top drive 21 is in a higher position thereof. This allows placement of a tubular 7 in the space between the working deck 14 and the top drive 21.

In an embodiment, e.g. as shown in FIG. 1, the first hoisting winch 17 comprises a first hoisting drum and the second hoisting winch 24 comprises a second hoisting drum.

In an embodiment, e.g. as in FIG. 1, the winches 17 and 24 are driven independently. In another embodiment the first hoisting winch 17 comprises a first hoisting drum and the second hoisting winch 24 comprises a second hoisting drum which drums are both driven by a single common winch drive 35, see the simplified illustration of FIG. 9*c*. In this case the first hoisting winch 17 and the second hoisting winch 24 are connected to the common winch drive 35 by a first transmission 36 and a second transmission 37 respectively, e.g. each comprising a planetary gear system.

Figure 2:
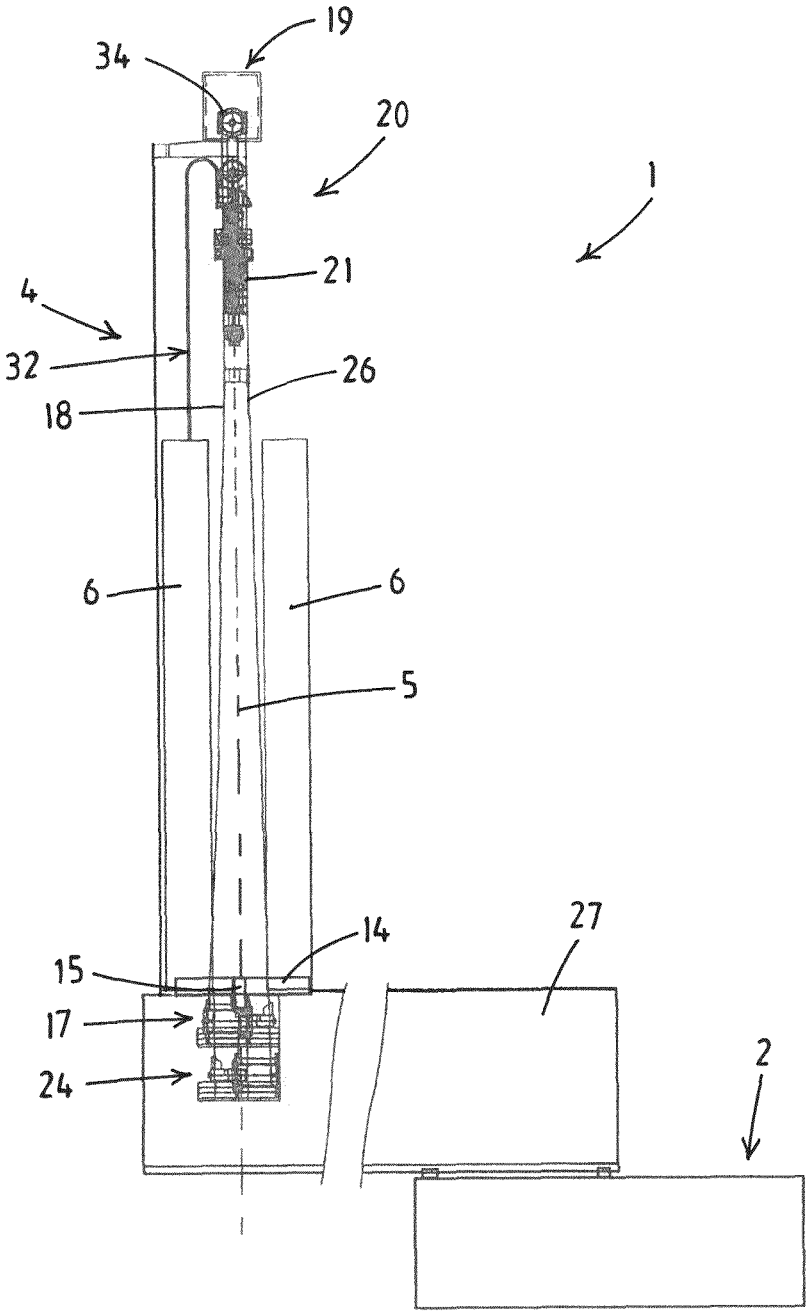
FIG. 2 depicts a side view of the offshore vessel of FIG. 1.

FIG. 2 depicts a side view of the offshore vessel 1 of FIG. 1. In this figure a mud hose 32 is visible that is connected to the top drive 21 to allow for transfer of mud to the string 9.

Figure 3:
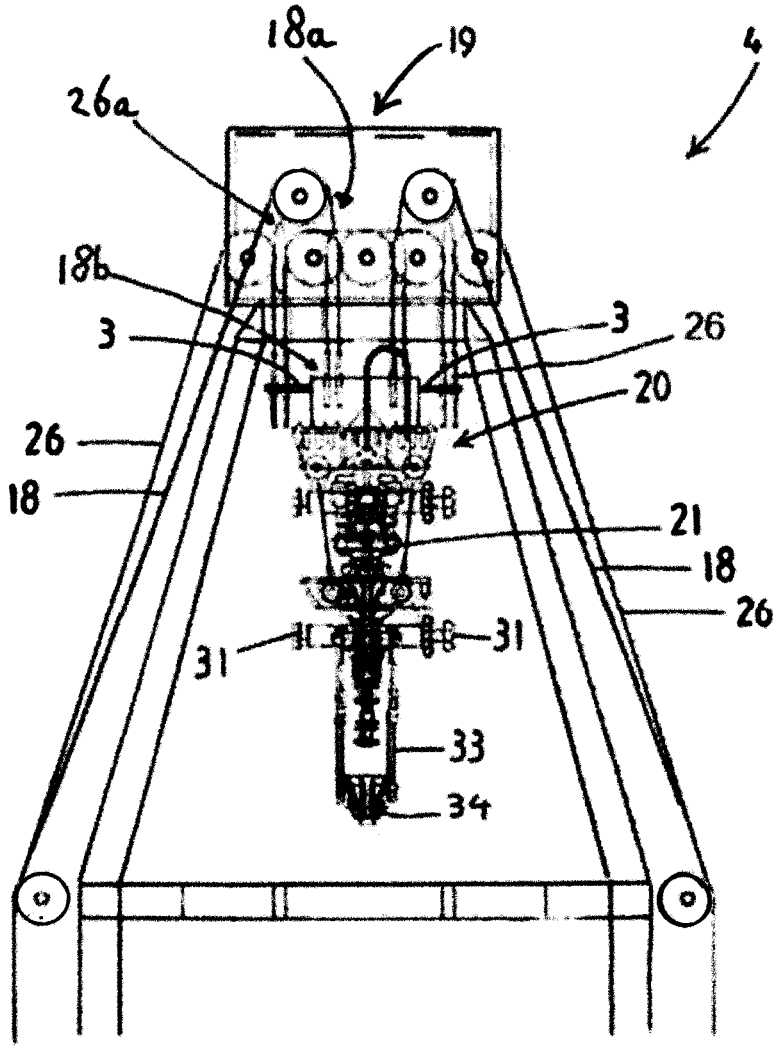
FIG. 3 depicts the top of the drilling tower with the traveling block and top drive in a highest position.

FIG. 3 depicts a close up of a traveling block 20 carrying the top drive 21 when located near the crown block 19 of a drilling tower 4 according to the invention.

Figure 4:
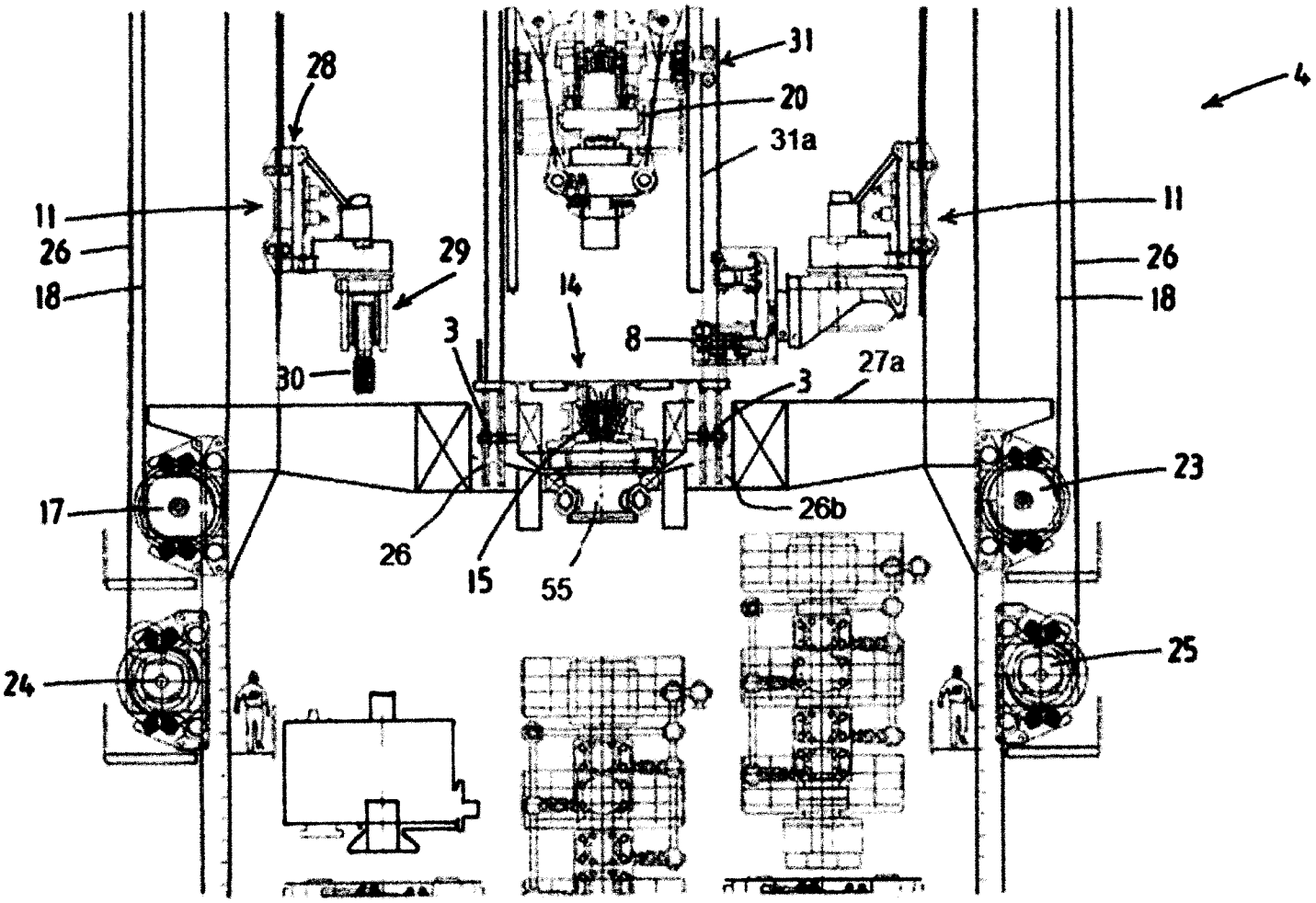
FIG. 4 depicts the working deck in a lower resting position thereof.

In FIG. 3 the second hoisting cable 26 is not connected to the working deck 14, which working deck 14 is then located in a lower resting position thereof (see FIG. 4). In this lower resting position the working deck 14 rests on the structure of the deck 27*a* of the vessel, here of the cantilever and in other embodiments, for example, on the hull of the vessel.

The deck 14 and the deck 27*a* may be provided with tracks that line up in this lower resting position so that equipment can be conveyed, e.g. skidded, over the lined-up tracks for transfer of equipment between the deck 14 and the deck 27*a*.

In FIG. 3, the second hoisting cable 26 is connected to the traveling block 20 by the connectors 3. In more detail, in the depicted embodiment, each connector 3 connects an associated set of one or more pulleys 26*b* to the travelling block 20, e.g. on either end of an array of pulleys 19*b* of the travelling block.

The connection of the cable 26 via the connector(s) 3 to the block 20 provides a configuration that provides increased load capability of the traveling block 20. This is useful, for example, during some stages of a drilling process when a high load, e.g. a lengthy drill string, is suspended from the traveling block 20, e.g. from the top drive 21 carried by the traveling block 20.

Figure 8:
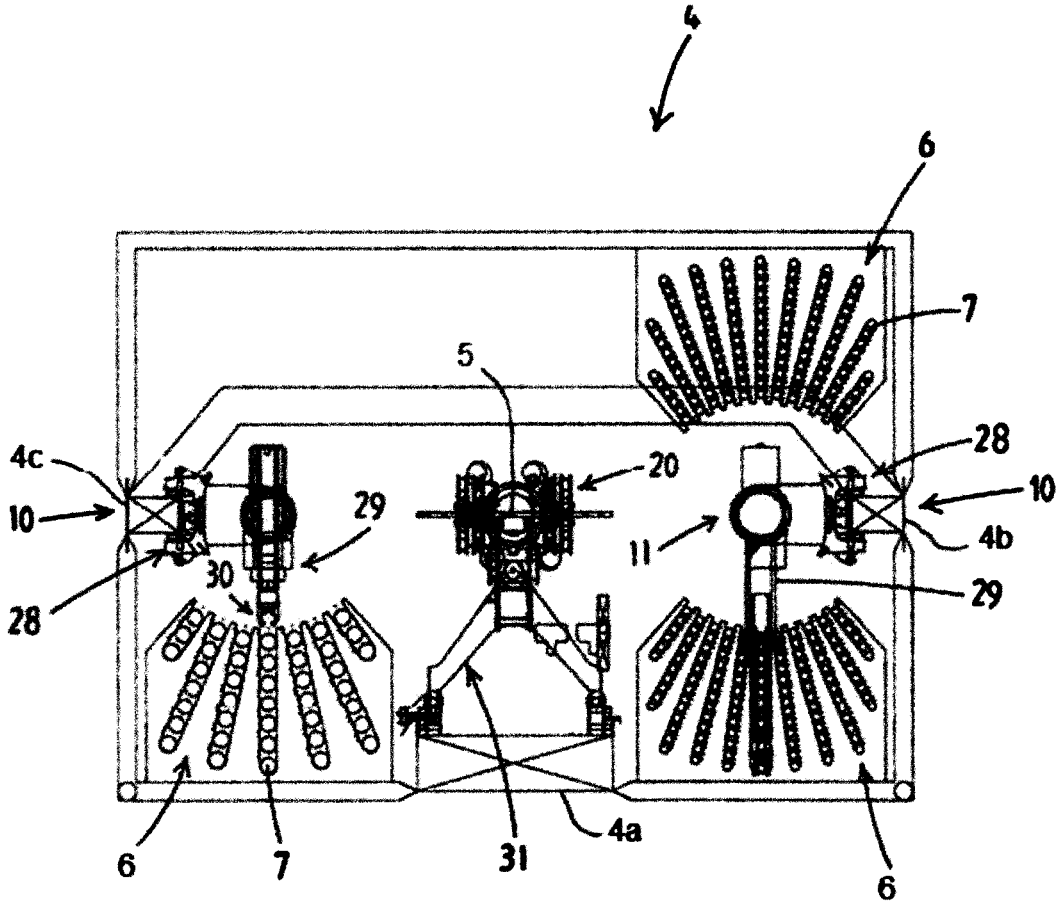
FIG. 8 depicts a top view of the drilling tower of FIGS. 1-3.

As can be seen in FIG. 8, for example, the top drive 21 is connected to a trolley 31 which guides the top drive 21 along the drilling tower 4, here along a vertical column 4*a* of the tower 4, e.g. along guide rails 31*a* thereon.

It is illustrated that the top drive 21 comprises bails 33 supporting an elevator 34 as is known in the art.

As can be seen in the FIG. 3 the first and second hoisting cables 18, 26 are guided between the crown block 19 and the hoisting winches on the outside of the drilling tower 4. It is possible, in other embodiments, that the first and second hoisting cables 18, 26, are guided along a different path between the hoisting winches and the crown block, for example, on the inside of the drilling tower 4.

In FIG. 4 another configuration is illustrated, wherein the connectors 3 are connected to the working deck 14 and not to the travelling block 20. This allows to raise and lower the working deck 14 by means of the second hoisting device, as the deck 14 is effectively suspended from the crown block by cable 26.

Figure 5:
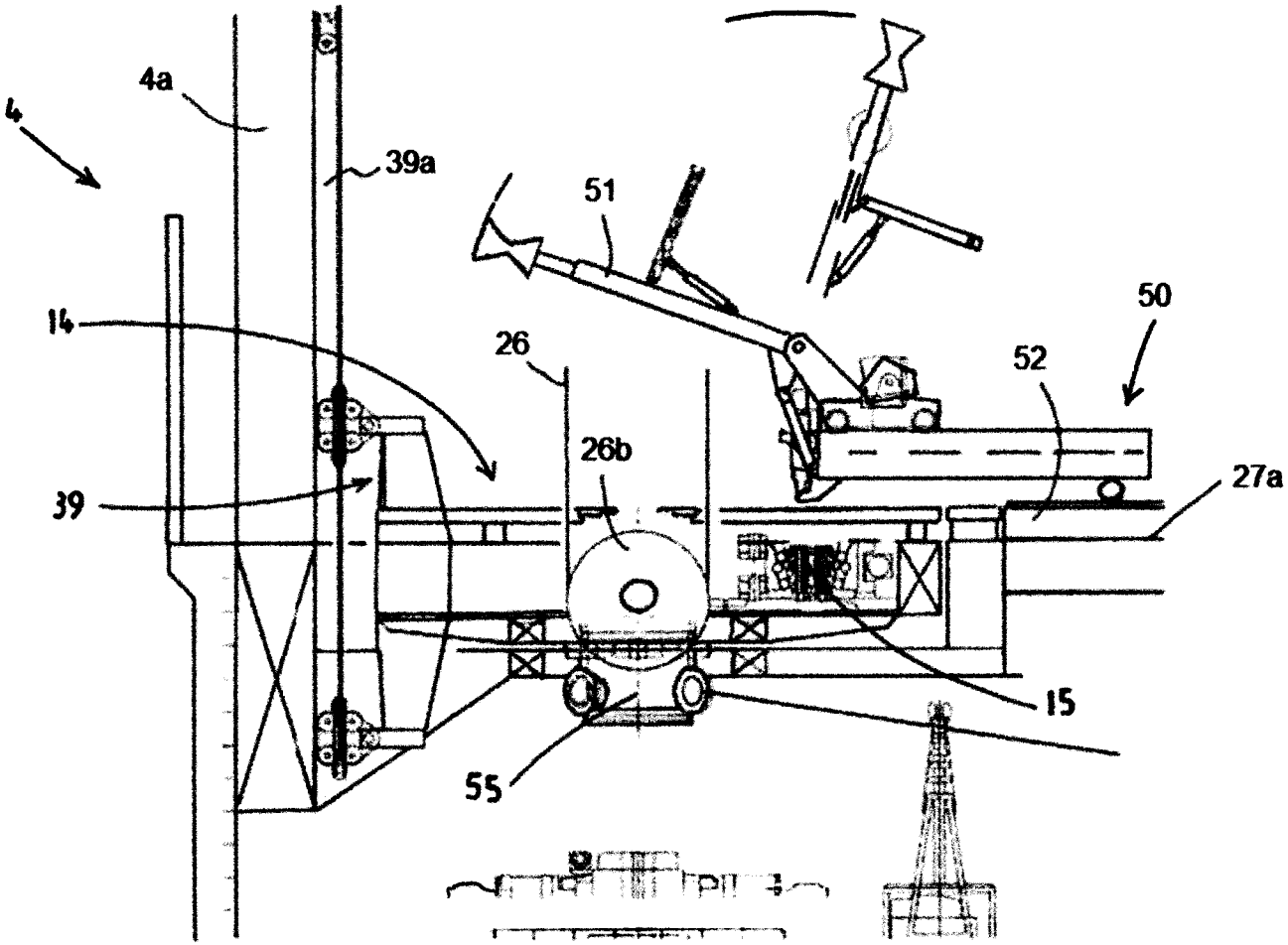
FIG. 5 depicts the working deck of FIG. 4 from the side.

In FIG. 4 the working deck 14 is in its lower resting position. In this figure the traveling block 20 and the top drive 21 are in a lower position thereof, adjacent the working deck 14. FIG. 5 depicts a close up of a side view of the working deck 14 in the lower resting position of FIG. 4. It is illustrated, as is an option, that the slip device 15 has been shifted into a retracted position, away from the operative position aligned with the firing line 5, e.g. to allow for operations wherein this slip device 15 is not needed. There could also be two slip devices 15 on the deck 14, each mobile between a retracted position and an operative position, the retracted positions being diametrically opposite from the firing line. This arrangement is known in the art.

As is shown in FIG. 4, the roughneck device 8 carried by assembly 11 can be used for make-up and break up of a tubulars string 9 in cooperation with the slip device 15.

The assembly 11 allows the roughneck device 8 to be vertically moveable, e.g. in synchronicity with motion of the deck 14, e.g. when the deck 14 is moved in heave compensating mode and make-up and or break-up of a drilling string can then also be performed by means of the roughneck device 8. In such heave motion approach, also the assemblies 12, 13 can be moved in coordination with the motion of the deck 14, so as to allow for transfer of tubulars 7 into and out of the firing line 5 above the deck 14 in said process.

FIG. 4 also illustrates that a diverter 55 is mounted to the deck structure 27*a*, below the working deck 14 in its lower resting position. The diverter 55 is well known in the art as part of the mud circulation and handling system.

FIG. 5 also illustrates a catwalk machine 50 with tailing-in arm 51 that is mounted on deck 27*a* and is movable over associated rails 52 into a position wherein the machine 50 extends partly over the deck 14 in its lower resting position. This is, for example, of use for deployment of a riser string as is known in the art.

Figure 6:
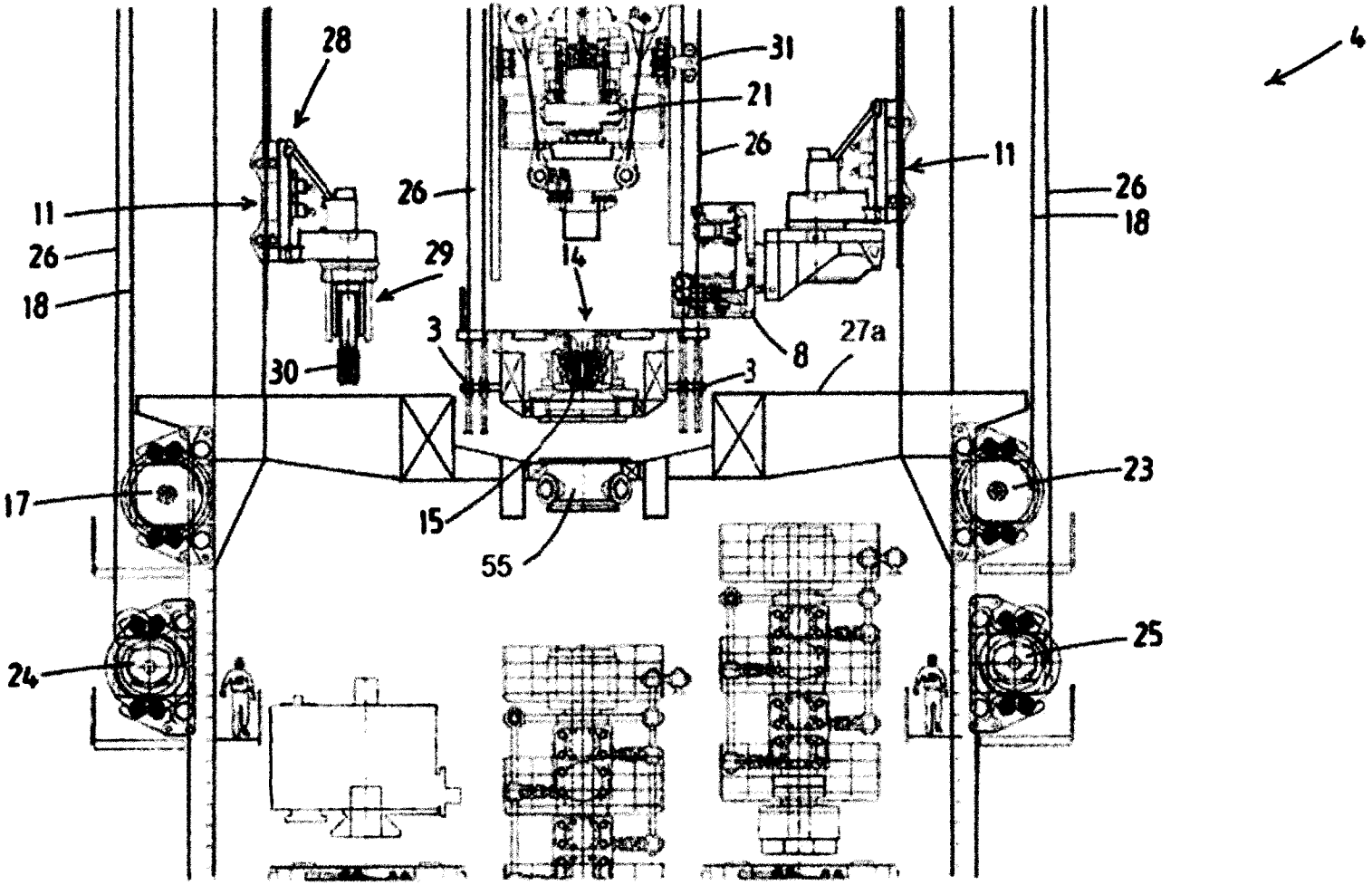
FIG. 6 depicts the working deck in a slightly raised position.

FIG. 6 depicts a close up of the working deck 14 in a slightly raised position relative to the position depicted in FIG. 4. In this FIG. 5 the working deck 14 and the slip device 15 thereon have been raised by the second hoisting device 22.

The FIG. 6 shows, as an embodiment, that the working deck 14 is vertically guided along the drilling tower 4, here along column 4*a*, by a working deck trolley 39 that is guide by one or more vertical guide rails 39*a*.

The FIG. 6 shows that the slip device 15 has been displaced from the firing line 5. This allows placement of a second slip device 15 which may be suitable for tubulars 7 with another diameter.

The FIG. 6 shows a tubular 7 which is moved towards the firing line 5 in a horizontal orientation. The tubular 7 may be upended by a tubular upending device or some other means.

Figure 7:
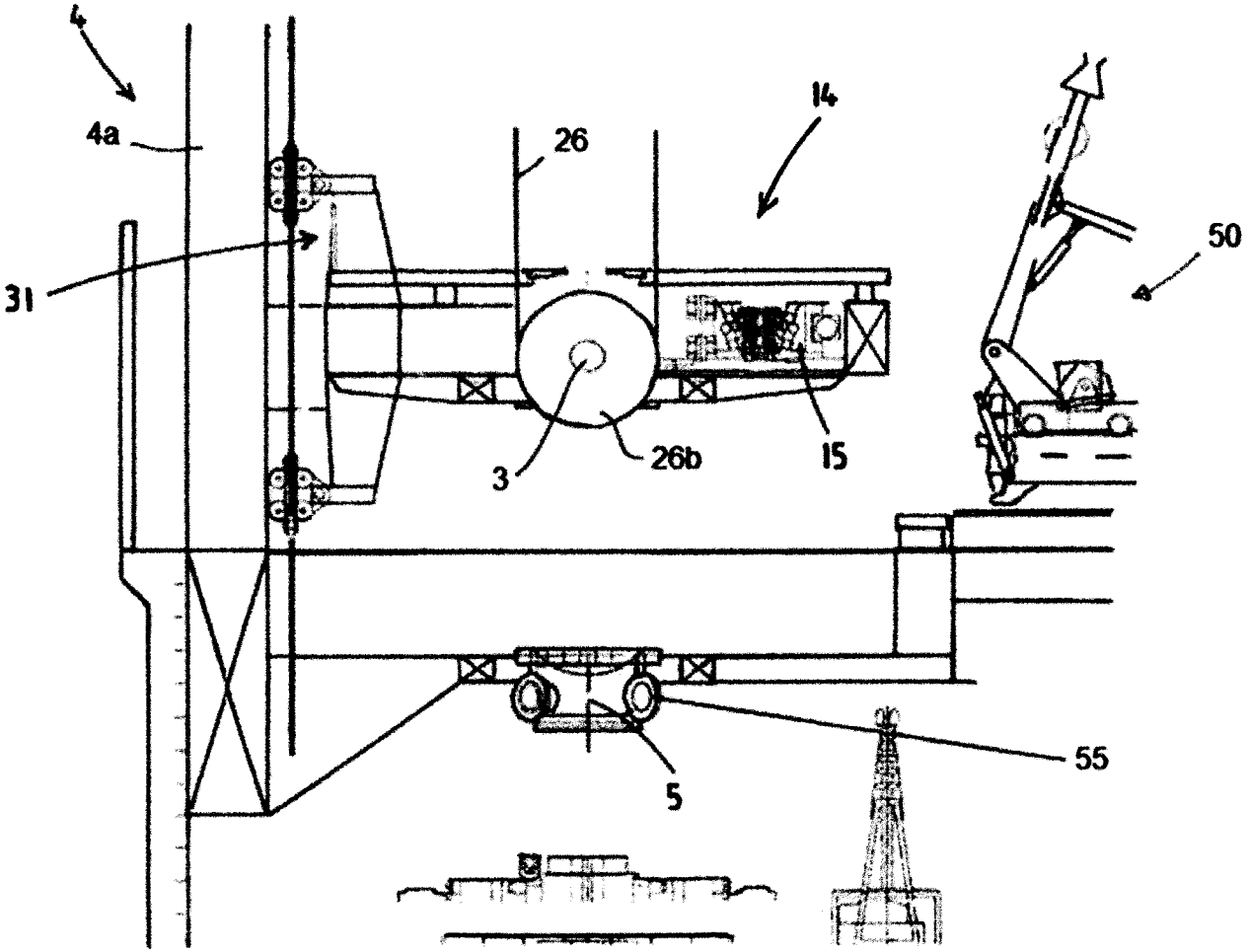
FIG. 7 depicts a side view of the working deck in a further raised position relative to the position depicted in FIG. 6.

FIG. 7 depicts a close up of a side view of the working deck 14 in a further raised position relative to the slightly raised position depicted in FIG. 6. The catwalk machine 50 has been retracted to allow for the raising of the working deck 14.

FIG. 8 depicts a top view of the drilling tower 4.

The FIG. 8 shows the three columns 4*a*, 4*b*, 4*c*.

The columns 4*b*, 4*c* are erected above the deck 27*a* at positions that are located diametrically opposite from the firing line 5. The column 4*a* is located offset from the plane through columns 4*b*, 4*c*.

The columns 4*a*, 4*b*, 4*c* merge at the top of the tower 4 to support the crown block 19.

The column 4*a* guides the trolleys 31 and 39 of the top drive 21 and the working deck 14 respectively.

The columns 4*b*, 4*c* each guide multiple vertical mobile motion arm assemblies 11, 12, 13 thereon.

The FIG. 4 shows, by way of example, three tubulars storage racks 6.

One rack 6 is within reach of the tubulars handling device 10 formed by assemblies 12, 13 on column 4*c*. The racks are within reach of tubulars handling device 10 formed by assemblies 12, 13 on column 4*b*.

The tubulars 7 may be arranged in radial slots centered on the vertical pivot axis of the motion arms 29 of the respective tubular racking device 10. Each tubular racker 10 can grab a tubular 7 from the storage rack 6 and transport it to the firing line 5.

FIG. 9*a* depicts a schematic representation of the drilling installation, wherein the first hoisting device and the second hoisting device are in a first configuration. In this configuration the first hoisting cable 18 is connected to the traveling block 20 which carries the top drive 21. The second hoisting cable 26 is now connected to the working deck 14 by the connectors 3. This configuration allows the traveling block 20 and the working deck 14 to be vertically moveable independently of each other, which includes motion in a synchronized manner when desired. In this configuration the tubulars string 9 can be tripped in or tripped out according to a method of the invention.

FIG. 9*b* depicts a schematic representation of the drilling installation, wherein the first hoisting device and the second hoisting device are in a second configuration. In the second configuration the first hoisting cable 18 and the second hoisting cable 26 are both connected to the traveling block 20 and the working deck 14 is located in the lower resting position thereof. The second hoisting cable 26 is connected to the traveling block 20 by the connectors 3. This configuration allows the traveling block 20 handle a larger load, e.g. a heavy drill string, a riser string, etc., than the first configuration depicted in FIG. 9*a*.

FIG. 9*c* depicts a schematic representation of a first hoisting winch 17 and a third hoisting winch 23 connected to a common winch drive 35, e.g. an electric motor. The common winch drive 35 is connected to the first hoisting winch 17 and the third hoisting winch 23 via a first transmission 36 and a second transmission 37 respectively. It is illustrated that each transmission 36, 37 can be embodied, as preferred, as a planetary gear transmission. This allows more efficient driving of the first and third hoisting winches because only a single drive 35 is necessary. For example, this reduces the amount of space needed for the winch drive on the vessel 1.

FIGS. 10*a*, 10*b*, 10*c* and 10*d* depict a drilling tower 4 and a hoisting system, which are placed on an offshore vessel 1, performing a tripping in operation according to a method of the invention. The second hoisting cable 26 is connected to the working deck 14 and the first hoisting cable 18 is connected to the traveling block 20 and the top drive 21.

Figures 10A, 10B, 10C, 10D:
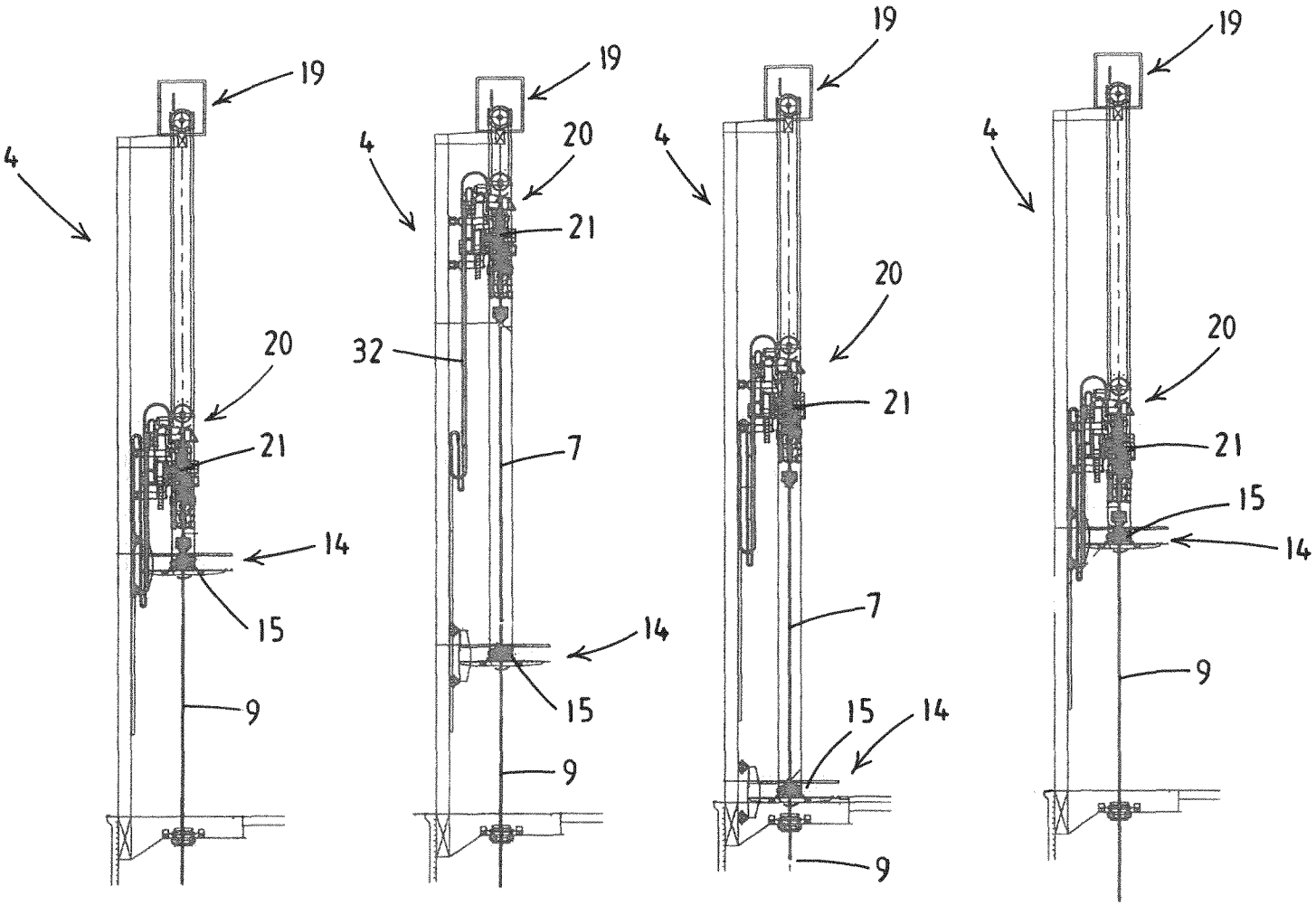
FIGS. 10*a*, 10*b*, 10*c* and 10*d* depict the wellbore drilling installation of FIGS. 1-8 performing a tripping in operation according to a method of the invention.

FIG. 10*a* depicts the drilling tower 4 and hoisting system in a starting position wherein the top drive 21 and the working deck 14 are located adjacent to each other. In order to be able to receive a tubular 7 the top drive 21 moves upward and the working deck 14 moves downward. In this embodiment a tubulars string 9 is suspended from the working deck 14 by the slip device 15. Thus while lowering the working deck 14 the tubulars string 9 is also lowered.

When the drilling tower 4 and hoisting system have reached the position depicted in FIG. 10*b*, the tubular 7 is placed between the working deck 14 and the traveling block 20 by the tubular racking device 10.

As the drilling tower 4 and the hoisting system move between the positions depicted in FIGS. 10*b* and 10*c*, the tubular 7 is connected to the tubulars string 9 and the traveling block 20 is being lowered to connect the top drive 21 to the tubular 7.

When the drilling tower 4 and the hoisting system are in the position depicted in FIG. 10*c* the tubulars string 9 is released from the slip device 15 and the tubulars string 9 is suspended from the traveling block 20.

The traveling block 20 is than lowered while the working deck 14 is simultaneously raised to place the drilling tower 4 and the hoisting system in the position depicted in FIG. 10*d* where the slip device 15 is engaged on the tubulars string 9 and the drilling tower and hoisting system are once again in the position depicted in FIG. 10*a*. This method depicted in FIGS. 10*a*-10*d* may be repeated multiple times to trip in a tubulars string 9.

Additionally the person skilled in the art understands that the method steps may be performed in reverse order to perform a tripping out operation according to the invention.

The invention claimed is:

1. An offshore vessel for performing subsea wellbore related activities wherein the vessel comprises:

a drilling tower and an associated firing line;

a crown block supported by the drilling tower;

a traveling block adapted to suspend a tubulars string therefrom along the firing line;

a hoisting system with a first hoisting device, the first hoisting device comprising a first hoisting winch and a first hoisting cable connected to said first hoisting winch, wherein the traveling block is suspended from the crown block by the first hoisting cable;

a roughneck device for connecting and disconnecting tubulars in assembly and disassembly of a tubulars string in the firing line, the roughneck device being vertically movable relative to the drilling tower;

a tubulars handling device, wherein the tubulars handling device is adapted to grip and retain a tubular and to move said tubular between a remote position, and a position in the firing line, and wherein the tubulars handling device is configured to vertically move a gripped and retained tubular between a lower position and a raised position in the firing line;

a working deck that is vertically moveable relative to the drilling tower; and a slip device that is mounted to the working deck and that is adapted to suspend the tubulars string therefrom in the firing line when the slip device is engaged with the tubulars string, wherein the hoisting system further comprises a second hoisting device comprising a second hoisting winch, a second hoisting cable connected to said second hoisting winch, and a connector suspended by the second hoisting cable from the crown block, wherein the connector is adapted to be selectively connected to one of the working deck and the traveling block, and wherein the hoisting system provides a first configuration and a second configuration, wherein, when the hoisting system is in the first configuration, the connector is connected to the working deck such that the working deck is raised and lowered by the second hoisting device and the traveling block is raised and lowered by the first hoisting device, and wherein, when the hoisting system is in the second configuration, the connector is connected to the traveling block such that the traveling block is suspended by both the first and second hoisting cables so that a tubulars string suspended from the traveling block is to be raised and lowered by both the first and second winches.

2. The offshore vessel according to claim 1, wherein the first hoisting winch comprises a first hoisting drum and wherein the second hoisting winch comprises a second hoisting drum, and wherein the first hoisting drum and, the second hoisting drum are connected to a common winch drive by a first transmission and a second transmission respectively, allowing the common winch drive to drive the first hoisting drum and the second hoisting drum.

3. The offshore vessel according to claim 2, wherein the first transmission and the second transmission each comprise a planetary gear system.

4. The offshore vessel according to claim 1, wherein the offshore vessel is a floating offshore vessel and further comprises a first heave compensation system for damping the effect of the movement of the vessel as a result of sea-state induced vessel motion on the first hoisting device and a second heave compensation system for damping the effect of the movement of the vessel as a result of sea-state induced vessel motion on the second hoisting device.

5. The offshore vessel according to claim 1, wherein the first hoisting system comprises a third hoisting winch, wherein the first hoisting winch is connected to a first end of the first hoisting cable and the third hoisting winch is connected to a second end of the first hoisting cable.

6. The offshore vessel according to claim 1, wherein the second hoisting system comprises a fourth hoisting winch, wherein the second hoisting winch is connected to a first end of the second hoisting cable and wherein the fourth hoisting winch is connected to a second end of the second hoisting cable.

7. The offshore vessel according to claim 1, wherein the first hoisting system comprises a third hoisting winch, wherein the first hoisting winch is connected to a first end of the first hoisting cable and the third hoisting winch is connected to a second end of the first hoisting cable, wherein the second hoisting system comprises a fourth hoisting winch, wherein the second hoisting winch is connected to a first end of the second hoisting cable and wherein the fourth hoisting winch is connected to a second end of the second hoisting cable, and wherein the third hoisting winch comprises a third hoisting drum and wherein the fourth hoisting winch comprises a fourth hoisting drum, and wherein the third hoisting drum and the fourth hoisting drum are connected to a second common winch drive by a third transmission and a fourth transmission respectively, allowing the second winch drive to drive the third hoisting drum and the fourth hoisting drum.

8. The offshore vessel according to claim 1, wherein the tubulars handling device is a tubular racking device comprising a lower first tubular racker assembly and a second tubular racker assembly operable at a greater height than the first tubular racker assembly, wherein each tubular racker assembly comprises a base, a motion arm connected to said base, and a tubular gripper member held by said motion arm.

9. The offshore vessel according to claim 1, wherein the working deck is located above a moon pool of the vessel and wherein the working deck covers at least a portion of the moon pool.

10. The offshore vessel according to claim 1, wherein the hoisting system comprises an electronic system configured to control the first hoisting device and the second hoisting device.

11. The offshore vessel according to claim 1, wherein the vessel further comprises a tubulars storage rack adapted to store therein multiple tubulars in a vertical orientation, wherein the tubulars handling device is adapted to place a tubular in and remove a tubular from the tubulars storage rack, and wherein the tubulars handling device has a reach at least allowing to transfer a gripped tubular between the tubulars storage rack and a position of the tubular aligned with the firing line.

12. A method for drilling a subsea wellbore, comprising the step of using an offshore vessel comprising a drilling tower and an associated firing line, the vessel further comprising:

a crown block supported by the drilling tower;

a traveling block adapted to suspend a tubulars string therefrom along the firing line;

a hoisting system with a first hoisting device comprising a first hoisting winch and a first hoisting cable connected to said first hoisting winch, wherein the traveling block is suspended from the crown block by the first hoisting cable;

a roughneck device for connecting and disconnecting tubulars in assembly and disassembly of a tubulars string in the firing line, the roughneck device being vertically movable relative to the drilling tower;

a tubulars handling device, wherein the tubulars handling device is adapted to grip and retain a tubular and to move said tubular between a remote position and a position in the firing line, and wherein the tubulars handling device is configured to vertically move a gripped and retained tubular between a lower position and a raised position in the firing line;

a working deck that is vertically moveable relative to the drilling tower; and a slip device that is mounted to the working deck and that is adapted to suspend the tubulars string therefrom in the firing line when the slip device is engaged with the tubulars string, wherein the hoisting system further comprises a second hoisting device comprising a second hoisting winch, a second hoisting cable connected to said second hoisting winch, and a connector suspended by the second hoisting cable from the crown block, wherein the connector is adapted to be selectively connected to one of the working deck and the traveling block, and wherein the hoisting system provides a first configuration and a second configuration, wherein, when the hoisting system is in the first configuration, the connector is connected to the working deck such that the working deck is raised and lowered by the second hoisting device and the traveling block is raised and lowered by the first hoisting device, and wherein, when the hoisting system is in the second configuration, the connector is connected to the traveling block such that the traveling block is suspended by both the first and second hoisting cables so that a tubulars string suspended from the traveling block is to be raised and lowered by both the first and second winches.

13. The method according to claim 12, wherein the method comprises a tripping-in routine, the tripping-in routine comprising the steps of:

connecting the second hoisting cable to the working deck using the connector so as to bring the hoisting system in the first configuration;

suspending the tubulars string from the traveling block;

engaging the tubulars string with the slip device on the working deck near a top end of the tubulars string and releasing the tubulars string from the traveling block thus suspending the tubulars string from the slip device;

lowering the working deck and the tubulars string while simultaneously raising the traveling block thereby creating a space for a tubular between the working deck and the traveling block;

placing a tubular in the firing line between the working deck and the traveling block by means of the tubulars handling device;

connecting, by means of the roughneck device, the tubular with the tubulars string while the working deck is being lowered by the second hoisting device;

lowering the traveling block and connecting the traveling block to a top end of the tubulars string;

releasing the tubulars string from the slip device thereby suspending the tubulars string from the traveling block; and lowering the traveling block and the tubulars string while simultaneously raising the working deck.

14. The method according to claim 12, wherein the method comprises a tripping-out routine, the tripping-out routine comprising the steps of:

connecting the second hoisting cable to the working deck using the connector so as to bring the hoisting system in the first configuration;

suspending the tubulars string from the traveling block;

raising the traveling block and the tubulars string while lowering the working deck;

engaging the slip device of the working deck to the tubulars string below an upper tubular, while the working deck, traveling block and tubulars string are being raised;

separating the upper tubular from the tubulars string using the roughneck device;

removing the upper tubular from the firing line using the tubulars handling device;

lowering the traveling block while simultaneously raising the working deck and tubulars string;

connecting the tubulars string to the traveling block and disengaging the slip device from the tubulars string thus suspending the tubulars string from the traveling block; and raising the traveling block and the tubular while simultaneously lowering the working deck.

15. The method according to claim 12, wherein the method comprises a drilling routine, the drilling routine comprising the steps of:

connecting the second hoisting cable to the traveling block using the connector so as to bring the hoisting system in the second configuration;

suspending the tubulars string from a top drive carried by the traveling block; and performing a wellbore drilling operation involving rotating the tubulars string by means of the top drive and lowering the drill string by means of the second hoisting device.

* * * * *